United States Patent [19]

Lewis

[11] 4,078,034

[45] Mar. 7, 1978

[54] AIR GAGE SPINNING PROCESS

[75] Inventor: Gary Brett Lewis, Richmond, Va.

[73] Assignee: E. I. Du Pont de Nemours and Company, Wilmington, Del.

[21] Appl. No.: 752,915

[22] Filed: Dec. 21, 1976

[51] Int. Cl.[2] ..... D01D 5/14

[52] U.S. Cl. ..... 264/181; 264/184

[58] Field of Search ..... 264/180–181, 264/184; 425/71

[56] References Cited

U.S. PATENT DOCUMENTS

| | | | |
|---|---|---|---|
| 2,975,024 | 3/1961 | Bennett | 264/180 |
| 3,002,804 | 10/1961 | Kilian | 264/181 |
| 3,996,321 | 12/1976 | Weinberger | 264/181 |

*Primary Examiner*—Jay H. Woo

*Attorney, Agent, or Firm*—C. Wayne Stephens

[57] ABSTRACT

The strength of aromatic polyamide filaments spun at high speed downwardly through a non-coagulating fluid into a liquid coagulating bath and subsequently through a spin tube containing the freshly spun filaments and coagulating liquid is improved when the filaments are abruptly deflected away from the walls of the spin tube a distance of 0.025 to 0.15 times the inside diameter of the spin tube.

6 Claims, 6 Drawing Figures

AIR GAGE SPINNING PROCESS

BACKGROUND OF THE INVENTION

Spinning of concentrated solutions of aromatic polyamides through a layer of non-coagulating fluid into a liquid coagulating bath and subsequently through a spin tube containing the freshly spun filaments and the coagulating liquid is known from U.S. Pat. No. 3,767,756. This process provides asspun fibers having an outstanding combination of tenacity, breaking elongation and initial modulus.

In order for such a process to be commercially practicable, high speed spinning is essential. However, as the spinning speed is increased, the strength of the resulting fibers decreases. Consequently, an improved process permitting high speed spinning without loss in fiber strength would be highly desirable.

SUMMARY OF THE INVENTION

The present invention provides a process for preparing high strength aromatic polyamide filaments at high spinning speeds.

The present invention provides a process for spinning a solution of an aromatic polyamide downwardly through a noncoagulating fluid into a liquid coagulating bath and subsequently through a spin tube containing the freshly spun filaments and coagulating liquid at a spinning speed of at least 300 mpm. wherein the freshly spun filaments and coagulating liquid are abruptly deflected away from the walls of the spin tube a distance of 0.025 to 0.15 times the inside diameter of the spin tube, the deflection being at the entrance of the spin tube or at a point no further from the entrance than the filaments will travel in 0.002 seconds at the spinning speed being used. Preferably the deflection distance is 0.05 to 0.125 times the inside diameter of the spin tube and the filaments are deflected at the entrance of the spin tube. Preferably the filaments pass through the spin tube in about 0.03 seconds or less and most preferably the filaments pass through the spin tube in less than 0.01 seconds. Advantageously, the filaments are additionally deflected away from the walls of the spin tube a distance of 0.025 to 0.15 times the inside diameter of the spin tube at the exit of the spin tube.

DETAILED DESCRIPTION OF THE PREFERRED EMBODIMENT

Figure 1:
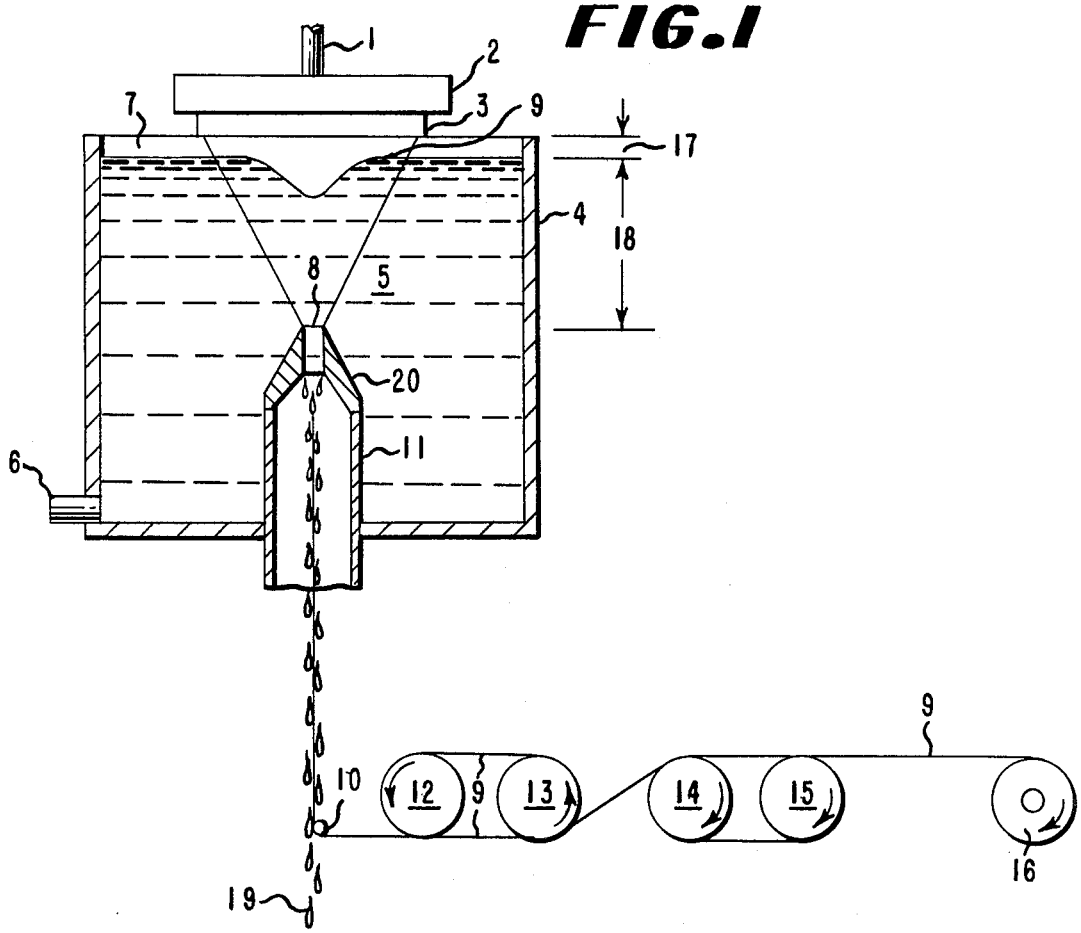
FIG. 1 shows a spinning scheme suitable for adaption to the process of the present invention.

In FIG. 1, spinning solution is supplied through transfer line 1 to spinning block 2 then to spinneret 3 located above the vessel 4 open to the atmosphere 7 containing a liquid coagulating bath 5 supplied from pipe 6. Extruded filaments 9 pass from the spinneret through the air gap 17 into the coagulating liquid and into the spin tube 8, downward through the relatively larger diameter tube 11 into the atmosphere to change of direction means 10 from where the filaments are pulled by driven roll 12 and its associated separator roll 13 and are washed and neutralized while on rolls 12 and 13. The bulk of liquid 19 falls from the filaments at means 10.

The yarn then passes to heated rolls 14 and 15 for drying and to windup on roll 16.

The vertical distance 17 from the face of the spinneret to the upper level of the coagulating liquid is termed the "air-gap". The vertical distance 18 from the top of the spin tube 8 to the upper surface of the coagulating liquid is termed the "stagnant layer".

Due to the large horizontal separation of filaments from the extreme ends of the spinneret and the relatively small diameter of the spin tube (the ratio may be 6:1 or larger) the outermost filaments enter the spin tube at a converging angle that may be 15° to 30° or more from the vertical. This convergence tends to drag the filaments along the walls of the tube.

Spin tube 8 is filled with liquid due to the pumping action of the filaments and gravity. The succeeding zones of larger cross-section beyond the spin tube such as are afforded by the spin tube holder 20 and tube 11 are not filled with liquid and do not significantly increase the tension on the filaments beyond that obtained by passage through the spin tube. Tube 11 functions primarily as a support for the spin tube holder and should have a diameter such that there is no contact between its inner wall and the falling liquid or decending filaments. The length of tube 11 is not critical and can extend to change of direction means 10 or even beyond with the provision of a side exit. Alternately, with a shallower vessel, tube 11 is not required and the yarn may exit from the spin tube into zones 22, 23 and 24 (see FIGS. 2–4) and thence into the atmosphere, or directly into the atmosphere. The apparatus is arranged and the process conducted so that the filaments pass through the spin tube in less than about 0.03 second (e.g., 22.9 cm tube at 457 mpm) and preferably less than 0.01 second (e.g., 9.1 cm. tube at 549 mpm) in order to minimize the development of tension.

Means 10 is located so that the filaments are in contact with liquid for at least 0.04 second before running over means 10 (e.g., 30.5 cm. at 457 mpm).

Figure 3:
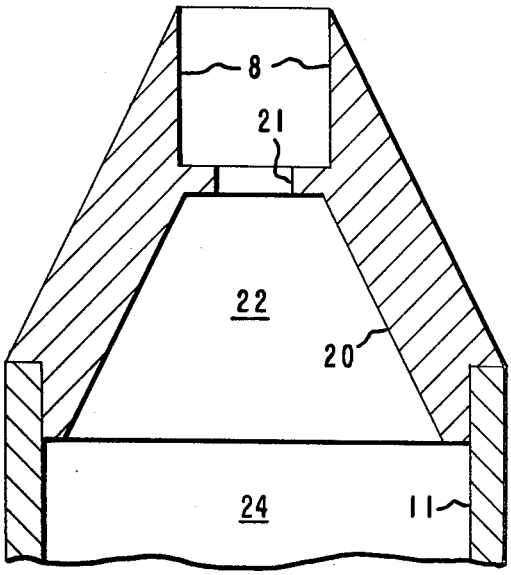
FIGS. 3–6 show spin tubes suitable for carrying out the process of the present invention.
Figure 4:
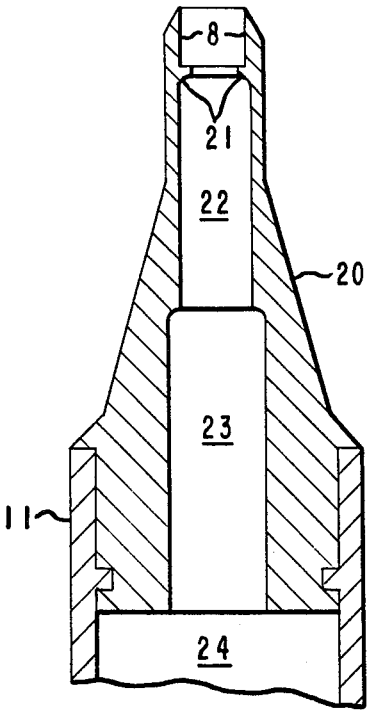
Figure 5:
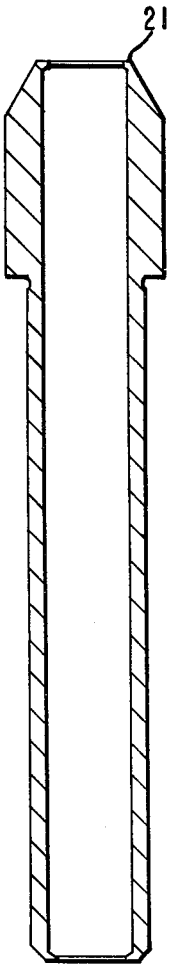

Embodiments of spin tubes with yarn deflection means 21 located at the top, or bottom, or top and bottom of the spin tube are shown in FIGS. 3, 4 and 5. It is believed that the yarn deflection means operate by physical displacement of the yarn and by providing a turbulent liquid layer at the wall that displaces the yarn. The circular shelf (21) of FIG. 3 presents a sharp edge perpendicular to the preceeding spin tube to provide maximum liquid turbulence in liquid at the edge of the tube. The shape of the lower face of the shelf is less critical due to the expanded diameter of that zone. If a shelf is used between the ends of a spin tube it should present a near perpendicular edge on both sides of the shelf in order to promote turbulent wall flow both up- and downstream of the shelf.

Preferably, the yarn deflection means are located at the entrance of the spin tube as shown in FIG. 5. As in the shelf of FIG. 3 the edges leading into and away from the deflection means must be sharp and near perpendicular to the tube. The effectiveness of the deflection means is significantly reduced as the angle to the tube approaches 135° or more, because the liquid stream lines at such angles will pull the yarn into contact with the tube wall.

It may be desirable to provide a multiplicity of yarn deflection means along the tube.

The yarn deflection means should have an inside diameter (I.D.) that is no larger than about 0.95 of the I.D. of the spin tube and can be as small as 0.70 or less.

Preferably the I.D. of the deflection means will be no larger than 0.9 [and no less than 0.75] of the spin tube I.D.

The minimum size of the I.D. of the deflection means and the spin tube is governed by the size of the yarn bundle and associated liquid and the mechanical problems of "stringing up" the process. The I.D. should be from 3 to 15, preferably 5 to 10, times the diameter of the yarn bundle and associated liquid. For example, the diameter of a 1000 filament, 1500 denier yarn with liquid is about 1 mm.

The face of the deflection means located at the entrance of the spin tube or midway should preferably be relatively shallow, e.g., 0.15 to 0.3 mm. thick whereas deflection means at the bottom of the tube, where the yarn is less sensitive, can be much thicker, e.g., 1–5 mm.

The present invention is useful at spinning speeds of 300 to 800 meters/min. or higher, preferably 500 to 700 meters/min.

TEST PROCEDURES

Fiber properties are measured at 24° C and 55% relative humidity on yarns that have been conditioned under the test conditions for a minimum of 14 hours. The nominal 1500 denier yarns of the examples are given about 0.8 turns twist/cm. (i.e., 1.1 twist multiplier) and broken with a 25.4 cm. gauge length at 50% strain/minute. Deniers are obtained by weighing a known length of yarn and corrected to a finish-free basis containing 4.5% moisture.

EXAMPLE I

General Procedure

Using an arrangement similar to that of FIG. 1, a spinning solution containing 18.8% by weight poly(p-phenylene terephthalamide) (PPD-T) having an inherent viscosity of 5.2 ($H_2SO_4$) is extruded at 85° C from a 4.8 cm. diameter spinneret containing 1000 0.064 mm. diameter orifices arranged within a 4.2 cm. diameter circle through a 9 mm. air gap into 10° C aqueous coagulating liquid containing 3–4% by weight $H_2SO_4$. The "stagnant layer" is 19 mm. thick. The filaments are pulled through a spin tube then through a larger tube 11 having an inside diameter of 24 mm., through the air and after washing, neutralizing and drying, wound up at 608 m./min.

Part A

Figure 2:
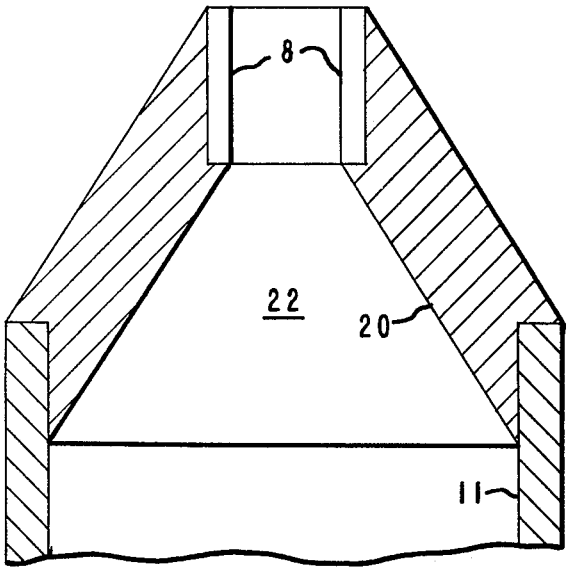
FIG. 2 shows a typical spin tube known in the art.

The above general procedure is followed using a straight spin tube with a square entrance edge as shown in FIG. 2. The spin tube has an inside diameter of 9.5 mm. and is 11.2 mm. long.

Part B

The above general procedure is followed using a spin tube similar to the spin tube of FIG. 3. The spin tube has an inside diameter of 12.7 mm. and is 7.6 mm. long before a 2.5 mm. thick square edged circular shelf having an inside diameter of 9.5 mm. located at the exit of the tube. The shelf provides a deflection of 1.6 mm. (0.126 times the inside diameter of the spin tube).

Part C

The procedure of Part B is followed except the length of the spin tube is 15.2 mm. before the shelf.

There is no statistically significant difference between the tenacities and breaking elongations of the yarns of Parts B and C which are tenacity = 20.8 gpd. and elongation = 3.4%. By comparison, the yarn of Part A has tenacity = 18.8 gpd. and elongation = 3.3%.

Part D

Repeating Part A using the same type of spin tube except that the upper edges are rounded and the length of the tube is 12.7 mm. at a spinning speed of 457 m./min. gives yarn having tenacity = 18.9 gpd. A comparable spin using the spin tube of Part B except the tube length is 12.7 mm. gives yarn having tenacity = 20.1 gpd.

EXAMPLE 2

General Procedure

Using an arrangement similar to that of FIG. 1, a spinning solution containing 19.2–19.5% by weight poly(p-phenylene terephthalamide) having an inherent viscosity of 5.2 ($H_2SO_4$) is extruded at 80° C from a 4.8 cm. diameter spinneret containing 1000 0.064 mm. diameter orifices arranged within a 4.2 cm. diameter circle through a 9 mm. air gap into 10° C aqueous coagulating liquid containing 4% $H_2SO_4$. The "stagnant layer" is 25 mm. thick. The filaments are pulled through a spin tube, through the air and after washing, neutralizing and drying, wound up at 457 m./min.

Part A

The above general procedure is followed using a spin tube similar to the tube shown in FIG. 4. The spin tube has an inside diameter of 12.7 mm. and a length of 12.7 mm. before a 2.5 mm. thick square-edged circular shelf having an inside diameter of 9.5 mm. Below the shelf is a 36 mm. long section having an inside diameter of 14.2 mm. which opens into a 48 mm. long section having an inside diameter of 19 mm. then into a tube having an inside diameter of 34.8 mm. The shelf provides a deflection of 1.6 mm. (0.126 times the inside diameter of the spin tube).

Part B

Figure 6:
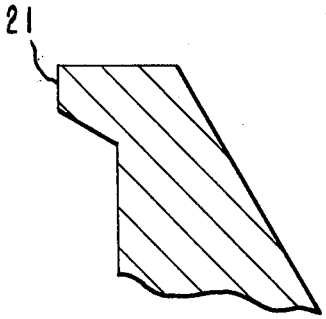

The procedure of Part A is followed except a spin tube similar to that of FIG. 5 is used, the entrance details of which are more clearly shown in FIG. 6. The top and bottom rims have an inside diameter of 6.35 mm. and are 0.25 mm. thick. The spin tubes has an inside diameter of 7.1 mm. and is 89 mm. long. The deflection is 0.375 mm. (0.053 times the inside diameter of the spin tube).

Part C

The procedure of Part B is followed except that the spin tube is 71 mm. long and only a top rim is used.

Part D

The procedure of Part C is followed by using a 15.2 mm. long spin tube of 9.53 mm. inside diameter having a top rim of 8.76 mm. inside diameter. The deflection is 0.385 mm. (0.04 times the inside diameter of the spin tube).

Parts A to D are carried out simultaneously for an extended period of time using a common source of spinning solution. The average tenacities and elongations of the resulting yarns are:

| Part | Tenacity, gpd. | Elongation, % |
|---|---|---|
| A | 20.3 | 3.6 |

-continued

| Part | Tenacity, gpd. | Elongation, % |
|---|---|---|
| B | 21.0 | 3.7 |
| C | 20.9 | 3.6 |
| D | 20.5 | 3.6 |

It can be seen that deflection of the yarn and coagulation liquid at the entrance of the spin tube is either equivalent or superior to deflection at a point removed from the entrance of the spin tube.

What is claimed is:

1. A process for spinning a solution of an aromatic polyamide downwardly through a noncoagulating fluid into a liquid coagulating bath and subsequently through a spin tube containing freshly spun filaments and coagulating liquid at a spinning speed of at least 300 mpm wherein the freshly spun filaments and coagulating liquid are abruptly deflected away from the walls of the spin tube a distance of 0.025 to 0.15 times the inside diameter of the spin tube, the deflection being at the entrance of the spin tube or at a point no further from the entrance than the filaments will travel in 0.002 seconds at the spinning speed being used.

2. Process of claim 1 wherein the deflection distance is 0.05 to 0.125 times the inside diameter of the spin tube.

3. Process of claim 1 wherein the filaments are deflected at the entrance of the spin tube.

4. Process of claim 1 wherein the filaments pass through the spin tube in about 0.03 seconds or less.

5. Process of claim 4 wherein the filaments pass through the spin tube in less than 0.01 seconds.

6. Process of claim 3 wherein the filaments are additionally deflected away from the walls of the spin tube a distance of 0.025 to 0.15 times the inside diameter of the spin tube, the additional deflection being at the exit of the spin tube.

* * * * *